US008960889B2

(12) United States Patent
Anderson et al.

(10) Patent No.: US 8,960,889 B2
(45) Date of Patent: Feb. 24, 2015

(54) METHOD OF PRINTING

(75) Inventors: Paul Anthony Anderson, Cambridge (GB); Roger Matthew Walkley, Cambridge (GB)

(73) Assignee: Inca Digital Printers Limited (GB)

( * ) Notice: Subject to any disclaimer, the term of this patent is extended or adjusted under 35 U.S.C. 154(b) by 270 days.

(21) Appl. No.: 13/319,046

(22) PCT Filed: May 7, 2010

(86) PCT No.: PCT/GB2010/050749
§ 371 (c)(1),
(2), (4) Date: Dec. 7, 2011

(87) PCT Pub. No.: WO2010/128335
PCT Pub. Date: Nov. 11, 2010

(65) Prior Publication Data

US 2012/0069109 A1 Mar. 22, 2012

(30) Foreign Application Priority Data

May 8, 2009 (GB) ..... 0907924.5

(51) Int. Cl.
*B41J 2/01* (2006.01)
*B41M 7/00* (2006.01)
*B41M 3/00* (2006.01)

(52) U.S. Cl.
CPC ..... *B41M 7/0081* (2013.01); *B41M 3/008* (2013.01)
USPC ..... 347/102

(58) Field of Classification Search
CPC ..... B41J 2/01
USPC ..... 347/102
See application file for complete search history.

(56) References Cited

U.S. PATENT DOCUMENTS 4,309,452 A 1/1982 Sachs
7,794,074 B2 9/2010 Vosahlo et al.
2003/0035037 A1* 2/2003 Mills et al. ..... 347/102
(Continued)

FOREIGN PATENT DOCUMENTS

GB 2390332 A 1/2004
GB 2399162 A 9/2004
(Continued)

OTHER PUBLICATIONS

International Search Report for PCT/GB2010/050749, mailed Jan. 26, 2011; ISA/EP.
(Continued)

*Primary Examiner* — Alessandro Amari
*Assistant Examiner* — Alexander C Witkowski
(74) *Attorney, Agent, or Firm* — Lerner, David, Littenberg, Krumholz & Mentlik, LLP

(57) ABSTRACT

The application describes a method and apparatus for controlling surface finish in the printing of a substrate in a plurality of passes using a curable print material and an ink jet printer having a radiation source. A first set of passes is carried out, including depositing ink on the substrate and emitting radiation from a radiation source toward the deposited ink. The emitted radiation applies a dose of radiation in a first range. A second set of passes is then carried out to deposit ink on the substrate. Further radiation is emitted from a radiation source toward the deposited ink, the emitted radiation applying a dose of radiation in a second range different from the first range.

18 Claims, 3 Drawing Sheets

(56) References Cited

U.S. PATENT DOCUMENTS

Figure 1A:
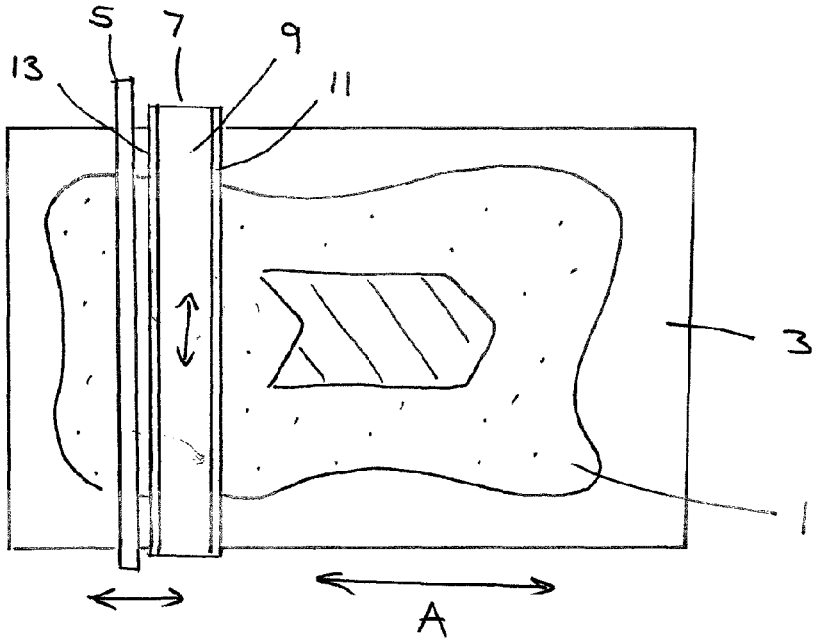

| | | | | |
|---|---|---|---|---|
| 2004/0141040 | A1 | 7/2004 | Nakajima | |
| 2005/0179725 | A1* | 8/2005 | Matsushima | 347/40 |
| 2006/0238592 | A1* | 10/2006 | Kadomatsu et al. | 347/102 |
| 2007/0040885 | A1 | 2/2007 | Kusunoki | |
| 2008/0225099 | A1* | 9/2008 | Cohen et al. | 347/102 |
| 2008/0295731 | A1* | 12/2008 | Odell et al. | 106/31.13 |

FOREIGN PATENT DOCUMENTS

| | | | |
|---|---|---|---|
| GB | 2484021 | A | 3/2012 |
| JP | 2000336295 | A | 12/2000 |
| JP | 2005531438 | A | 10/2005 |
| JP | 2007125886 | A | 5/2007 |
| JP | 2007268789 | A | 10/2007 |
| JP | 2007276248 | A | 10/2007 |
| JP | 2007313718 | A | 12/2007 |
| JP | 2008530619 | A | 8/2008 |
| JP | 2010524739 | A | 7/2010 |
| WO | WO-2004002746 | A1 | 1/2004 |
| WO | WO 2004002746 | A1 * | 1/2004 ..... B41J 11/00 |
| WO | WO-2004056581 | A1 | 7/2004 |
| WO | WO-2008068211 | A1 | 6/2008 |
| WO | WO-2008129298 | A2 | 10/2008 |

OTHER PUBLICATIONS

United Kingdom Search Report for GB 0907924.5, dated Aug. 24, 2009.

Japanese Office Action for Application No. 2012-509095 dated Dec. 24, 2013.

United Kingdom Search Report for GB 0907924.5, dated Nov. 30, 2012.

* cited by examiner

METHOD OF PRINTING

CROSS REFERENCE TO RELATED APPLICATIONS

This application is a U.S. National Stage Application of International Application No. PCT/GB2010/050749, filed May 7, 2010 and published in English as WO/2010/128335 on Nov. 11, 2010. This application claims the benefit of GB Application No. 0907924.5, filed May 8, 2009. The disclosures of the above applications are incorporated herein by reference.

This invention relates to printing using a curable printing medium. Examples of the invention relate to the printing using curable printing materials, including, without limitation, curable ink.

Aspects of the invention find particular application in the printing of images using ink, but are also applicable more widely to the printing of any curable material onto a substrate. Particular aspects of the invention relate to the printing of material onto a substrate in which the printed material has a particular surface structure or appearance. Some aspects relate to methods of printing images having a varied surface structure, appearance or gloss. Aspects of the invention relate to the printing of images which are wholly or partly glossy. Aspects of the invention find application in printing using an inkjet printer.

The use of curable print materials in printing is well known. Curable inks typically solidify by reaction, for example by polymerisation and/or crosslinking, on exposure to radiation. Of particular interest are UV curable inks, which cure on exposure to UV light. Curable inks are commonly used in inkjet printing processes, in which droplets of ink are emitted from the nozzles of an inkjet printhead that is moved relative to a substrate. The droplets of ink contact the substrate and are subsequently cured, commonly using a radiation source. The printed image is typically built up in successive scans or passes of one or more printheads relative to the substrate. Ink laid down in subsequent scans or passes is deposited onto the substrate and/or onto previously laid down ink deposited in previous passes.

In some arrangements, the surface appearance, for example gloss level, of the printed image may be changed by selecting the power emitted by the radiation source on different passes. Where a matt finish is required, the radiation source is typically operated at a constant high power (e.g. full power) throughout the printing process, giving a relatively rough, and therefore matt, surface. Without wishing to be bound by theory, it is believed that the matt surface is formed because drops of ink deposited on substantially fully cured ink of previous passes have a high contact angle on the surface giving a surface structure and thus a matt finish.

For a glossier finish to be formed, for example the radiation source is operated at a lower power (for example at 5% power), causing the ink to partially cure. Again, without wishing to be bound by particular theory, partially cured ink has a non-solidified surface allowing greater wetting of the surface by ink droplets that are applied in a subsequent pass, leading to a flatter and/or less rough final surface and a glossier finish to the print. In examples, the radiation source can then be switched to a higher power (for example full 100% power) for one or more additional passes to fully cure the ink film, thereby rendering the surface relatively glossy.

A further or alternative problem which can be encountered in the printing of images which contain one or more areas that have less ink deposited than others. For example where an image with white or light-coloured areas is to be printed onto a white substrate, the white areas in the final image will normally contain little or no ink and consequently will have a gloss level or surface finish similar to that of the substrate. Thus, differential gloss levels may result across the surface of the image, particularly where a substrate having a matt finish is employed for the printed image.

According to a first aspect of the invention there is provided a method of controlling surface finish in the printing of a substrate in a plurality of passes using a curable print material and an ink jet printer having a radiation source, the method including steps of:

carrying out a first set of passes, a pass of the first set of passes including depositing ink on the substrate and emitting radiation from a radiation source toward the deposited ink, the emitted radiation applying a dose of radiation in a first range, subsequently carrying out a second set of passes, a pass of the second set including depositing ink on the substrate and emitting radiation from a radiation source toward the deposited ink, the emitted radiation applying a dose of radiation in a second range different from the first range.

By using applying different radiation doses in the different sets of passes, different curing in the different sets of passes can be achieved, thus leading to control of surface finish and the possibility of creating desired surface effects in some examples as discussed in more detail below. By printing the passes having different surface finishes at different times, greater efficiency of printing, and control of surface texture or finish can be obtained.

For example radiation of different power may be emitted in the first and second sets of passes.

Preferably the dose is measured as energy per unit area applied to the printed ink (for example measured in J/m2). Alternative methods for determining the dose could be used, where appropriate.

Preferably the first dose range and the second dose range are such that the curing effected of the printed ink in the first set of passes is different from the curing effected of the printed ink of the second set of passes.

Preferably the first dose and the second dose are such that the surface finish of the printed ink of the first set of passes is different from the printed ink of the second set of passes.

In examples described herein, the ink of one set is more glossy than that of the other set, the other ink being more matt.

The radiation source of the first set may be the same or different from that of the second set. For example, in some arrangements, the power output of the source may be adjustable. In other arrangements, the use of different sources having different power outputs will be preferred. Other options are described below.

The first set and/or the second set preferably include a plurality of passes comprising deposition of ink.

In this way, the desired image is formed, and it is also possible in some examples to achieve the desired surface effects. For example, in many arrangements, the matt surface effect is preferably formed by depositing ink onto a previously deposited, and fully cured, layer of ink. Thus a matt surface can be built up in a plurality of passes. It is thought that the use of a plurality of passes is less important for the formation of a gloss finish, but in practice in many examples, a plurality of passes will be desirable to build up the image on the substrate at the desired print resolution.

Preferably one of the first set and the second set of passes effects partial cure of the ink, the other effecting substantially full cure of the ink.

Thus relatively matt and gloss finishes can be obtained.

Where reference is made to partial cure, preferably the curing step is carried out such that the upper or exterior surface of the partially cured material is not solidified, and preferably is in liquid and/or gel form. Preferably the external surface of the partially cured material is such that a subsequent layer of print material applied to the partially cured material will wet the partially cured layer. In this way, in some examples, though not wishing to be bound by particular theory, a more glossy surface can be obtained compared with methods in which a subsequent layer of ink is applied to a substantially solidified layer. Examples of methods for carrying out a partial cure are described in International Patent Application No. WO2004/002746. Examples of radiation sources for carrying out partial curing and/or full curing are described in International Patent Application No. WO2004/056581.

The dose of the emitted radiation one of the first set of passes and the second set of passes may be less than about 20% or less than about 10%, preferably about 5% or less of the dose of the emitted radiation of the other set of passes.

For example the power of the emitted radiation of one set may be less than about 20%, or less than about 10% preferably less than 5% of the power of the other set.

The lower dose of radiation can effect partial curing in some examples. It will be appreciated that the dose of the radiation emitted in each of the passes of a set might not all be the same, but preferably the range of dose emitted is lower in one set than in the other set, preferably the upper value of the lower range is less than 20%, or less than about 10% of the lower value of the upper range.

There are various different methods which can be used to give areas of the printed surface different surface finishes. Preferably one of the surface finishes is more glossy than the other, more matt, one to give regions of the printed substrate different surface finishes. For example a glossy logo could be provided on a matt background.

The first set of passes may effect printing of ink onto a first region of the substrate, the second set of passes effecting printing of ink onto a second region of the substrate different from the first region.

The first and/or second sets of passes may of course effect printing onto a plurality of different areas of the substrate. There may be overlap between the first and second regions so that some regions are printed in both the first set and the second set of passes. In some examples, this would be less preferred as it may lead to the use of additional ink compared with examples of less overlap. However, in other arrangements, such an overlap will be preferred, for example to achieve the desired surface effects. Such examples are described in more detail below.

The method may further include a transitional set of passes between the first and second sets of passes, the transitional set of passes including one or more ink deposition passes and/or one or more passes including emitting radiation from a radiation source.

In some examples, it is possible to have an "overlap" between a first curing mode and second curing mode as discussed further below. Alternatively or in addition, further printing and/or curing passes may be provided before, between, or after the passes of the first and/or second set, as desired. Each set of passes may include one or more passes. A single radiation source, or multiple radiation sources could be used, as appropriate.

There are various preferred examples of printing in accordance with the invention.

The first set of passes may include emitting radiation having a relatively lower dose to effect partial curing of the ink, and the second set of passes include emitting radiation having a relatively higher dose to effect substantially full cure of the ink.

In this way, during the first set of passes, layers of ink are laid down and partially cured, giving a relatively glossy surface. In the second set of passes, the deposited ink is substantially fully cured before the deposition of the next layer, giving a relatively matt surface. Where the first and second sets of passes of ink are deposited in different areas, this can give rise to glossy regions and matt regions of the printed substrate. Where the second passes of ink are printed onto previously printed regions in the first passes, glossy regions formed in the first passes can be made to look more matt by reason of the addition of ink from the second passes.

It is preferred for the gloss areas to be printed first, because the partially cured ink of the gloss printing can be further cured during the subsequent curing of the ink of the matt printing. Furthermore, efficiencies can be made in the printing. For example, the method may include a transitional pass including the deposition of ink onto regions including partially cured ink, and onto regions not including partially cured ink, and emitting radiation to effect substantially full cure of the ink on the regions including partially cured ink, and onto the regions not including partially cured ink.

In this way, the transitional pass comprises an "overlap" of the last pass of the printing of the gloss print, and the first pass of the printing of the matt print. The high dose radiation can be applied to the whole printed region, and effects both cure of the gloss and matt areas. Thus a separate final "partial curing" pass for the gloss print can be avoided, thus increasing efficiency of the printing, by reducing the number of passes required.

Print material may be printed onto the second portion prior to, concurrently with or after printing of print material onto the first portion of the substrate. In an embodiment, print material is printed onto the second portion after print material on the first portion has been partially cured, and optionally after further print material has been printed onto said first portion. In another embodiment, print material is printed onto said second portion prior to printing print material on said first portion.

Ink of the second set of passes may be printed onto ink deposited in the first set of passes.

In this way, the surface finish of the ink deposited can be further controlled. For example, the relatively glossy surface can be changed during the second set of passes by applying a relatively matt surface onto it in one or more regions.

Ink of the first and/or second set of passes may include substantially transparent or translucent ink or varnish.

In this way, different surface textures can be applied to a printed image using a varnish or other translucent or transparent print material. Where used, preferably one or more passes of the second set of passes includes printing at least a part of the pass using translucent or transparent ink. It will be appreciated that other surface effects could be provided by printing using different print materials.

In an alternative, varnish, transparent or translucent ink or other printing material could be used to make a matt print more glossy. However, this would be difficult to achieve in many examples given the surface structure of the underlying matt print.

The area of the substrate onto which print material is printed may be the whole or part of the substrate.

Preferably the printer is a digital inkjet printer.

In some arrangements the printheads of the printer extend substantially the full width of the substrate being printed.

Preferably the printer is a full width printer, although other arrangements are possible and aspects of the invention described herein are applicable to a wide range of different printers. In some examples, the printer is a flatbed printer.

In some examples the ink is preferably UV curable ink and the radiation source includes a UV radiation source.

According to a further aspect of the invention there is provided a method of controlling surface finish in the printing of a substrate in a plurality of passes using a curable print material and an ink jet printer having a radiation source, the method including steps of:

carrying out a first set of passes, a pass of the first set of passes including depositing ink on the substrate and emitting radiation from a radiation source toward the deposited ink to produce a printed surface having a first surface finish, subsequently carrying out a second set of passes, a pass of the second set including depositing ink on the substrate and emitting radiation from a radiation source toward the deposited ink, to produce a printed surface having a second surface finish different from the first.

Preferably one of the surface finishes is more glossy than the other.

A method according to any preceding claim in which the image to be printed includes heavy print areas for which a relatively high dose of ink is to be deposited and further includes light print areas for which a relatively low dose of ink is to be deposited, the method comprising:

depositing the ink on the substrate to form the image, the ink deposited including the dose of ink required to print the image, and further including an additional dose of ink, the additional dose of ink being deposited in a light area of the printed image.

This feature is of particular importance and is provided independently.

According to a further aspect of the invention, there is provided a method of printing an image on a substrate in a plurality of passes, using curable print material and an ink jet printer comprising a radiation source, wherein the image to be printed includes heavy print areas for which a relatively high dose of ink is to be deposited and further includes light print areas for which a relatively low dose of ink is to be deposited, the method comprising:

depositing the ink on the substrate to form the image, the ink deposited including the dose of ink required to print the image, and further including an additional dose of ink, the additional dose of ink being deposited in a light area of the printed image.

Where printed images include light areas for which little or no ink is required to be deposited to form the image, difficulties can arise in attempts to control the surface finish of the image. This is because, although the surface finish of the image can be controlled where there is a relatively large amount of ink deposited, for example using techniques described herein, controlling surface finish where there is little or no ink deposited is difficult, because those light areas tend to have the surface finish of the underlying substrate, which is often neither similar to a matt or a gloss ink finish.

By depositing additional ink in the light regions, control of the texture of the ink surface can be improved.

Preferably the additional ink deposited does not change the appearance of the print significantly other than the surface finish. Therefore Preferably the additional ink has a colour similar to that of the substrate, or is translucent or transparent.

The additional ink may be white, or may comprise a varnish.

The additional ink may be printed in the same pass as ink of the image.

The additional ink my be printed in one or more of the existing printing passes for printing the image, and/or separate printing passes may be added to print the additional ink. If the light area is to be matt, or gloss, the additional ink is preferably printed as a part of the relevant first or second set of passes.

This method may be used to print an image comprising a portion which is substantially white. For instance, in preference to using the whiteness of the substrate as the basis for a substantially white portion of the finished image, a substantially white or colourless print material may be printed onto said portion of the substrate and cured. In this way, the gloss level of the portion can be controlled such that there is less variation in relation to the remainder of the printed image.

It will be appreciated that where the colour of the substrate is other than white, a different colour of ink might be used instead of white.

The following features may be applied to any aspect, embodiment or feature described herein.

The methods disclosed herein are generally applicable to a wide variety of printers. Features of the method are particularly suitable where a continuous array of printhead nozzles is provided, such as in the case of inkjet printers, so that the printed image can be built up in layers.

Unless otherwise stated, the curable print material used in the methods disclosed herein is preferably a curable ink, in particular a UV curable ink. The term "ink" should be interpreted broadly to include any appropriate printing material to be deposited on the substrate.

Preferably the ink has low volatility.

Preferably the substrate and the ink are such that there is little absorption of the ink into the substrate.

Preferably a substantial proportion of the deposited ink remains on the substrate, preferably on the surface of the substrate. For example, preferably at least 50%, more preferably at least 60%, 70%, 80% or at least 90% of the ink remains on the substrate, preferably on the surface of the substrate. This is to be contrasted with solvent-based inks where only a small amount of the ink deposited remains on the substrate.

A radiation source may comprise one or more elements, for example one or more mercury lamps or LEDs. In some arrangements, a radiation source extends across the full width of the image being printed, and preferably across the full printable width of the substrate. In other arrangements, smaller radiation sources may be used.

Where a method requires the application of different doses of radiation, this may achieved in various ways, for example using a different number of sources, a different power input to the sources, a different configuration of sources, or by turning off one or more elements of the sources or by varying the relative speed of the source and the substrate. In particular, one or more radiation sources may be used. For example, different radiation sources may be used for the first and second curing steps. Alternatively, one source may comprise a subset of another source and/or an altered version of another source.

The printer may include one or more radiation sources having a baffle, a screen or a shutter. The use of baffles, screens or shutters can effectively change the dose of radiation received at the substrate for curing the ink. Screens or shutters are thought to be particularly useful in the case where the first dose is required to be less than 20%, less than 10% or about 5% of the further dose. It is difficult to control the power input to a radiation source to be less than 10% of power, as the source (particularly in the case of mercury lamps) may have a tendency to turn off. In some cases, turning radiation sources on and off to obtain the required radiation dose is also not an attractive option because some sources take some considerable time to warm up from being off to being ready for use. The use of movable shutters provides a potentially simple but effective solution. Where a plurality of radiation sources are used, each radiation source may comprise a baffle or screen in a different configuration.

Alternatively or additionally, the speed of relative movement of the radiation source and the substrate during the first and further curing steps may be different. In this way, different curing doses can be obtained for each curing step. In some cases the same radiation source, operating at the same power, could be used for both steps, the different dose being delivered by means of selecting an appropriate speed of relative movement of the radiation source and substrate.

The percentage of the effective dose of the radiation (for example, the dose or curing energy per unit area received at the substrate) in a first curing step compared with a further curing step may be, for example, determined by consideration of the relative power outputs of the radiation sources used for the first and further curing steps, preferably taking into account the effect of any baffles or screens and the like, and the relative speed of movement of the source and substrate. In some cases, in particular where the speed of relative movement between the printheads and the substrate is the same for the first and any further curing steps, it may be convenient to consider the relative doses of radiation to be equivalent to the dose of radiation emitted by the radiation source in the first and further curing steps.

Preferably the wavelength of the radiation used in a partial curing step is greater than about 370 nm, preferably approximately between 380 nm and 420 nm, and more preferably approximately between 385 nm and 400 nm. The phrase "wavelength" preferably connotes a nominal wavelength, for example as might be used by manufacturers to identify a type of curing lamp, or by reference to the most dominant wavelength in a group of wavelengths emitted by a given radiation source, for example.

The wavelength of the radiation used in a partial curing step may even be greater than about 420 nm, for example using different colours of the visible and infrared spectrum. The desired wavelength will depend on the type of ink used, in particular the curing initiators used in the ink. However, the use of relatively long wavelengths will tend to cure the part of the drop adjacent the surface more than the exposed surface, which is desirable in that it can aid immobilisation of the drop on the substrate. The long wavelength radiation is thought to be more penetrating into ink drops close to the substrate and thus effect cure deep in the droplets.

Depending on the nature of the curing required one or more curing steps may be conducted in the presence of an inerting or low oxygen environment, for example a nitrogen inerting environment. There are several ways in which to achieve this. Using a local nitrogen atmosphere, for example, can reduce the inhibition of the free radical reaction by the presence of oxygen, which diffuses into the ink surface. Mercury arc lamps overcome the effect of oxygen inhibition by emitting enough power such that the rate of free radical production exceeds the rate at which oxygen diffusion can inhibit the reaction. Whereas the need to use a nitrogen atmosphere adds complexity to the system, this is more than compensated by the other advantages described above.

The term "inerting" is to be understood to include reference to an argument in which the inerting gas or environment has the effect of reducing inhibition of cure of the ink. The inerting gas or environment may be itself inert, but in many cases it will be sufficiently inerting without itself being completely inert. Thus a low-oxygen gas may provide an inerting environment. For example, carbon dioxide gas and/or nitrogen gas may be used.

The radiation used in any fully curing step preferably includes radiation having a wavelength less than the wavelength used in partial curing steps. By contrast to the relatively long wavelength radiation preferably used in the partial cure step, this shorter wavelength radiation can overwhelm the oxygen inhibition effect at the surface and effect solidification of the ink at the surface.

Preferably, the radiation used in a full curing step includes radiation having a wavelength less than about 360 nm, preferably approximately between 300 nm and 350 nm, and more preferably approximately between 320 nm and 340 nm. The radiation used in the full curing step may include radiation having a wavelength greater than about 370 nm, preferably approximately between 380 nm and 420 nm, and more preferably approximately between 385 nm and 400 nm, for example by employing the same radiation source used in the partial curing step, preferably in addition to a further radiation source of shorter wavelength. The use of both short and long wavelengths afforded by this combination can effect the full cure within the ink as well as substantially at the surface of the ink.

Each of the methods disclosed herein may include carrying out further printing passes and curing steps.

The invention also provides apparatus for carrying out any of the methods described herein, and a printed substrate printed by a method described herein.

Aspects of the invention also provide apparatus for carrying out any features of these method aspects.

The invention also provides a computer program and a computer program product for carrying out any of the methods described herein and/or for embodying any of the apparatus features described herein, and a computer readable medium having stored thereon a program for carrying out any of the methods described herein and/or for embodying any of the apparatus features described herein.

Any feature in one aspect of the invention may be applied to other aspects of the invention, in any appropriate combination. In particular, method aspects may be applied to apparatus aspects, and vice versa.

Figure 1B:
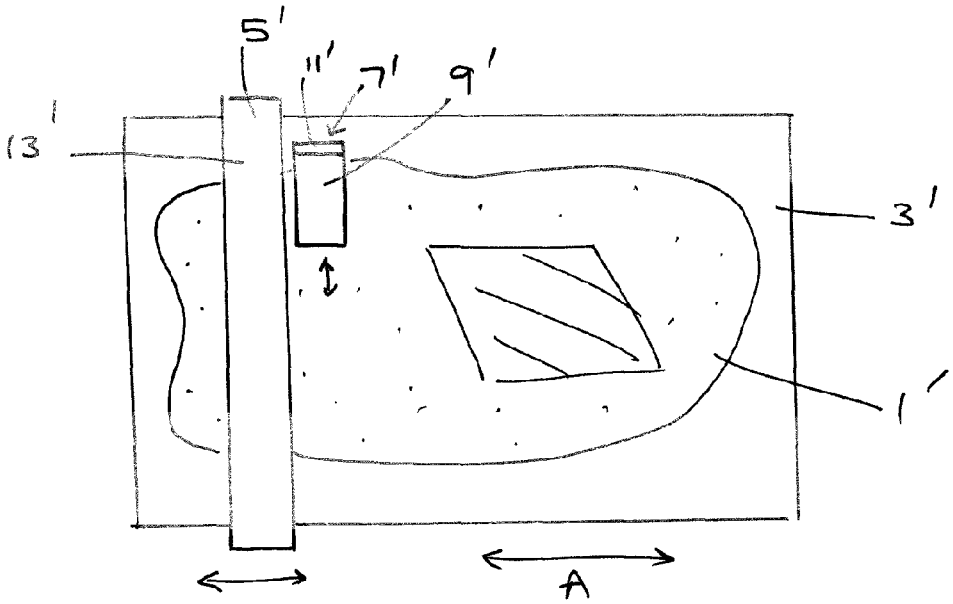
Figure 2A:
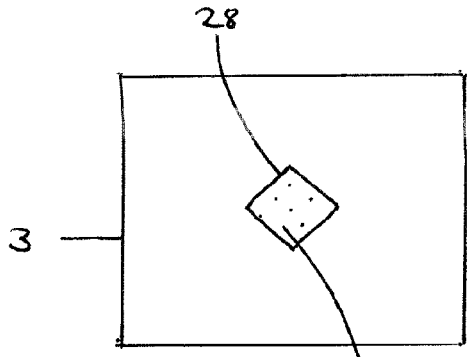
Figure 3A:
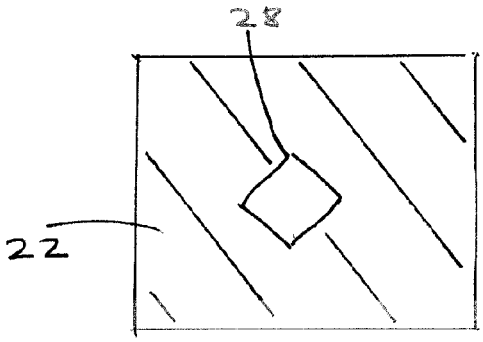
Figure 4A:
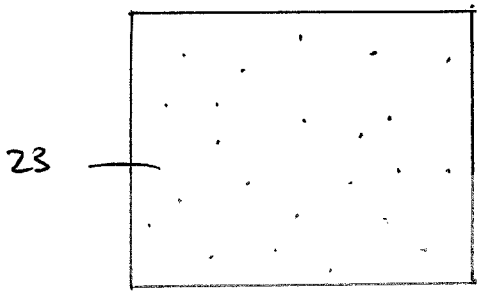
Figure 5:
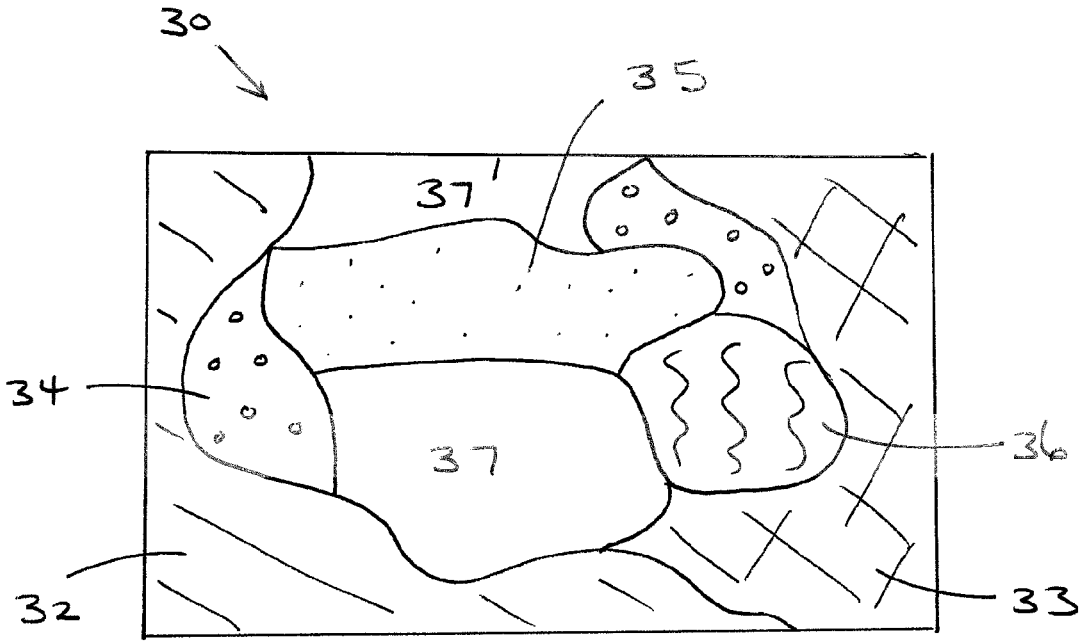

Preferred features of the present invention will now be described, purely by way of example, with reference to the accompanying drawings, in which:

FIGS. 1*a* and 1*b* show schematically two examples of printing apparatus which can be used in methods of the present invention;

FIGS. 2*a* and *b* show the deposition of ink in a first printing example;

FIGS. 3*a* and *b* show the deposition of ink in a second printing example;

FIGS. 4*a* and *b* show the deposition of ink in a third printing example;

FIG. 5 shows an image of varying colour and ink density to be printed.

FIGS. 1*a* and 1*b* show schematically two examples of printing apparatus which can be used in examples described herein. The skilled person will understand that other printer arrangements could be used to carry out printing operations described herein.

FIG. 1*a* shows a part of an ink jet printer arranged to print an image 1 on a substrate 3. The printer includes a support beam 5, the support beam 5 and the substrate 3 mounted for relative movement in a printing direction A. Depending on the arrangement, the beam 5 and/or the substrate may be movable. For example, the substrate 3 may be mounted on a movable substrate table or bed (not shown) in a known way.

A printhead arrangement 7 is mounted on the beam 5 and includes a plurality of printheads 9 arranged in an appropriate array. The printhead arrangement further includes one or more radiation sources 11, 13 mounted adjacent the printheads upstream and/or downstream relative to the printing direction A. The number and arrangement of the radiation sources being chosen having regard to the printer arrangement and operation, for example as to whether bidirectional printing is to be used (in which case curing devices on both sides of the printheads are preferred), and whether a single radiation source or different radiation sources are to be used to generate the different power curing radiation.

In the example of FIG. 1*a*, the image 1 is printed on the substrate 3 in a series of layers as the printhead arrangement 9 moves relative to the substrate 3 in the printing direction A. In between scans of the printhead, the printhead arrangement 9 is indexed in a direction perpendicular to the printing direction A so that the image can be printed onto the substrate. In the arrangement shown in FIG. 1*a*, the printheads extend substantially the full width of the substrate; arrangements in which the printheads extend less than the full width are possible, in which case greater indexing of the printheads will be necessary to print the full area of the substrate.

As the ink is deposited onto the substrate 3 during the printing, the radiation source 11, 13 is activated to emit radiation to cure the deposited ink. The wavelength and power of the radiation is chosen so as to produce the desired level of cure given the speed of relative movement of the source and the substrate.

FIG. 1*b* shows an alternative arrangement in which the image 1' is printed on the substrate 3' in a series of swathes as the printhead arrangement 9' moves relative to the substrate 3' in a scan direction perpendicular to the printing direction A. Between scans of the printhead 9', the beam 5' and substrate 3' move relative to each other in the printing direction A.

As the ink is deposited onto the substrate 3' during the printing scans, the radiation source 11' on the printhead arrangement 7' is activated if a partial curing is being carried out. If a full cure is being carried out, a full substrate width radiation source mounted at the beam 5' is used. As the beam 5' indexes during printing, the radiation source passes over the full area of the printed substrate to cure the ink.

The radiation sources may be any appropriate source having regard to the arrangement used and the nature of the material to be cured. In some arrangements mercury lamps could be used. As an alternative or in addition, arrays of LEDs or other radiation sources could be used for the partial cure and/or the full cure.

FIGS. 2 to 5 illustrate four different methods for obtaining a printed surface having a controlled surface finish. For simplicity, FIGS. 2*a* and *b* and FIGS. 3*a* and *b* show the forming of a single gloss region 20 having a relatively glossy surface finish, the remainder of the printed image being a matt region 22 having a relatively less glossy surface finish.

In the method illustrated in FIGS. 2*a* and *b*, the regions to be glossy 28 are printed first in a first set of printing passes, and the matt areas are subsequently printed in a second set of printing passes. In this example, four printing passes are required to print the full image onto each area of the substrate. In the first set of passes four printing passes are carried out to print ink into the area to be glossy 28. After each printing pass, the radiation source emits a relatively low dose of radiation on the substrate including the printed area 20 so that each printed pass of ink in the gloss area 28 is partially cured after printing. In this way, a subsequent pass of ink printed onto the area wets the previously applied ink to give a low contact angle with the surface and thus a relatively glossy printed area 20.

In the second set of passes, four passes of ink are printed onto the area to be matt. After each printed pass, the radiation source applies a relatively high dose of radiation to the substrate. This high dose substantially fully cures the print deposited in each of the passes of the second set of passes. The radiation applied also acts to complete the cure of ink applied in the glossy area 20. In the matt area, because each pass of ink deposited is substantially fully cured before the next pass, ink laid down on a previously cured pass has a low contact angle on the cured surface and thus a relatively matt surface is formed. Thus the full image is printed and cured in eight passes. An optional further curing pass may be carried out to ensure substantially full cure of the printed image.

In an alternative method, the same image may be printed using fewer than eight passes.

In the first set of passes, three passes of ink are printed and partially cured in the glossy region 28. In the next pass, a transitional set of passes is used. This set includes one pass in which ink is deposited both in the gloss region 28 and in the matt region 22 and a high dose cure is carried out. Because the ink deposited in the gloss region 28 is printed onto a partially cured layer, a gloss surface is formed and is fully cured in the transitional set. Because the ink printed in the matt region is printed onto the substrate and fully cured, this then forms the first pass of the matt printed area 22. The printing then follows with a second set of passes comprising three passes including deposition of ink onto the matt area 22, the ink being substantially fully cured after each pass. Thus four passes of ink have been applied to each area and the curing carried out to produce a gloss region 20 and a matt region 22 using only seven passes.

In the example shown, there is substantially no overlap of the gloss and matt regions, however this is an option in some examples. For example it may be preferred for the gloss regions printed in the first set of passes to extend slightly into the area to be matt, the matt regions being printed onto this overlap region to give a better interface between the areas. However, it will generally not be preferred for matt regions to be printed into gloss areas because if "gloss" is printed on top of a matt region, it will be difficult to achieve the required gloss effect if the "gloss" area has a foundation comprising a matt region.

Figure 2B:
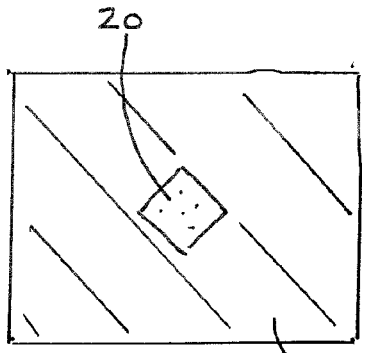
Figure 3B:
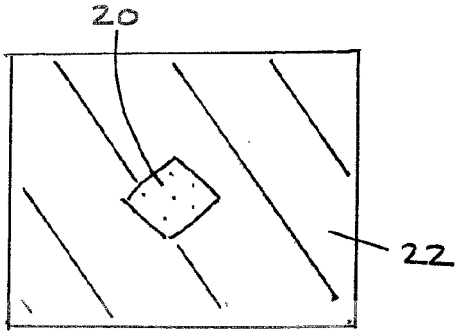

The method illustrated in FIGS. 3*a* and 3*b* is similar to that of FIGS. 2*a* and 2*b*, except that the regions to be matt 22 are printed first in the first set of printing passes, the gloss region 20 being printed in the second set of printing passes. In this example, the image is formed in four printing passes for each printed area. In the first set of printing passes, ink is deposited in the areas to be matt 22 and each pass of ink is substantially fully cured to form the matt surface. Subsequently, in the second set of printing passes, the regions to be gloss are printed and a partial cure is carried out after each pass of ink is deposited to form a relatively gloss surface. After the second set of passes, one or more further curing passes are carried out at high dose to effect substantially full cure of the ink on the substrate.

Thus it is seen that there are a total of at least nine passes for this method.

It is also not possible to carry out the transitional set of passes as for the example of FIGS. 2*a* and 2*b*. Thus, it is seen that at least one extra curing pass is needed compared with the arrangement of FIGS. 2*a* and *b*. Thus this method may be slower than the method described above. However, for some situations, this method may be preferred.

Figure 4B:
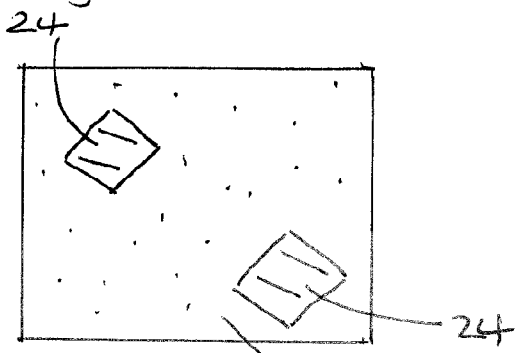

A further alternative is shown in FIGS. 4*a* and 4*b* in which an image is produced in which a glossy surface 25 has areas of matt surface finish 24. In a first set of printing passes, passes of ink are deposited, each followed by a partial cure at relatively low dose to form a glossy surface 23. In a subsequent second set of passes, further ink is deposited in one or more regions 24, the ink being substantially fully cured after each printing pass to form regions 24 having a relatively matt surface. During the high dose cure of the second set of passes, the ink in the glossy areas also achieves substantially full cure.

In an alternative example, substantially the full surface is covered with the second set of printing passes, so that the overall surface texture of the image can be controlled. By controlling for example the distribution of ink of the second set of passes and the curing regime, relatively close control of the resulting surface finish can be achieved. For example covering a gloss underlayer with a small number of matt mode passes maintains the high colour saturation of the gloss mode whilst avoiding the distracting highlights of full gloss. This is a different finish from that achievable with a single range of dose applied throughout all the passes. The surface finish may be different at different regions of the surface; it may be different in different matt regions.

It will be seen that these examples require the use of additional ink to other examples described, but will nevertheless be advantageous in some arrangements.

The print material or "ink" applied in the second set of passes may be ink for printing the image itself or may be for example transparent or a varnish, applied to effect the surface finish without changing substantially the printed image itself.

Thus varnish can be used to make a glossy print matt. Thus a preprinted image can have its surface texture adjusted using this method.

FIG. 5 illustrates an image printed onto a substantially white substrate 30. The image includes several regions of different colour 32 to 36. In the light areas 37, 37', the image is substantially white and so in known methods, little or no ink would be printed. In an example, at least one layer of white ink is printed into the light areas 37, 37'. This ink can be printed as a part of the printing passes of the image, and/or additional passes could be used. By applying ink in the light areas, more control over the surface texture in those areas is possible, for example using any of the methods described herein. Thus it is possible to give even those light areas the desired surface finish in relation to the remainder of the printed image. Where a method such as those described above is used to control surface finish, the white ink is printed in the light areas in the first set of passes or second set of passes depending on whether those areas are to have a relatively gloss or relatively matt surface finish. As an alternative, or in addition, a varnish, for example a colourless or transparent varnish, or a different coloured ink, could be applied in the light areas 37, 37'.

It will be understood that where the substrate or base layer being printed is a colour other than white, an appropriate colour ink or varnish could be used in those regions intended to be substantially the same colour as the substrate.

It will be understood that the methods described above are only an example of the different methods which could be used. In most cases, more than one layer of ink would be laid down in each region so as to obtain the desired surface coverage and colour for the image. Appropriate printing and curing regimes can be devised to achieve the desired surface finish.

It will be understood that the present invention has been described above purely by way of example, and modification of detail can be made within the scope of the invention. Each feature disclosed in the description, and (where appropriate) the claims, may be provided independently or in any appropriate combination.

The invention claimed is:

1. A method of controlling surface finish in the printing of a substrate in a plurality of passes using a curable print material and an ink jet printer having a radiation source to produce a printed image having a first surface finish in a first region and a second surface finish in a second region wherein one of the surface finishes is more glossy than the other, the method including steps of:

carrying out a first set of passes, a pass of the first set of passes including first depositing ink on the at least the first region of the substrate and emitting radiation from the radiation source toward the first deposited ink, the emitted radiation applying a first dose of radiation in a first range, carrying out at least one transitional pass including depositing ink on both the first and the second regions of the substrate and emitting radiation from the radiation source toward the deposited ink of such transitional pass, the emitted radiation of such transitional pass applying a second dose of radiation in a second range different from the first range, subsequently carrying out a second set of passes, a pass of the second set including second depositing ink on the second region of the substrate and emitting radiation from the radiation source toward the second deposited ink, the emitted radiation of the second set of passes applying a third dose of radiation in a third range different from the first range, wherein the first dose range and the third dose range are such that the curing effected of the printed ink in the first set of passes is different from the curing effected of the printed ink of the second set of passes, wherein the first dose and the third dose are such that the surface finish of the printed ink of the first set of passes is different from the printed ink of the second set of passes wherein the dose of the emitted radiation of one of the first set of passes and the second set of passes is less than about 20% of the dose of the emitted radiation of the other set of passes.

2. The method according to claim 1, wherein the first set and/or the second set include a plurality of passes comprising deposition of ink.

3. The method according to claim 1 wherein one of the first set and the second set of passes effects partial cure of the ink, the other effecting substantially full cure of the ink.

4. The method according to claim 1, wherein the dose of the emitted radiation of one of the first set of passes and the second set of passes is less than about 10%, preferably about 5% of the dose of the emitted radiation of the other set of passes.

5. The method according to claim 1, wherein the first dose is a relatively lower dose to effect partial curing of the ink, and the second dose is a relatively higher dose to effect substantially full cure of the ink.

6. The method according to claim 5 wherein the transitional pass includes the deposition of ink onto regions including partially cured ink, and onto regions not including partially cured ink, and the emission of radiation to effect substantially full cure of the ink on the regions including partially cured ink, and onto the regions not including partially cured ink.

7. The method according to claim 5 wherein ink of the second set of passes is printed onto ink deposited in the first set of passes.

8. The method according to claim 1, wherein ink of the first and/or second set of passes includes substantially transparent or translucent ink or varnish.

9. The method according to claim 1 wherein the printer includes printheads which extend substantially the full width of the substrate being printed.

10. The method according to claim 1 in which the image to be printed includes heavy print areas for which a relatively high dose of ink is to be deposited and further includes light print areas for which a relatively low dose of ink is to be deposited, the method comprising: depositing the ink on the substrate to form the image, the ink deposited including the dose of ink required to print the image, and further including an additional dose of ink, the additional dose of ink being deposited in a light area of the printed image.

11. The method according to claim 10, wherein the additional dose of ink has a colour similar to that of the substrate, or is translucent or transparent.

12. The method according to claim 10, wherein the additional dose of ink is printed in the same pass as ink of the image.

13. An apparatus for carrying out the method of claim 1.

14. The method according to claim 13, wherein ink of the first and/or second set of passes includes substantially transparent or translucent ink or varnish.

15. A printed substrate printed by a method according to claim 1.

16. The method according to claim 15, wherein ink of the first and/or second set of passes includes substantially transparent or translucent ink or varnish.

17. A method of controlling surface finish in the printing of a substrate in a plurality of passes using a curable print material and an ink jet printer having a radiation source, the method comprising:

carrying out a first set of passes, a pass of the first set of passes including first depositing ink on the substrate and emitting radiation from the radiation source toward the first deposited ink to produce a printed surface having a first surface finish, carrying out at least one transitional pass including depositing ink on both a first and a second region of the substrate and emitting radiation from the radiation source toward the deposited ink of such transitional pass, the emitted radiation applying a second dose of radiation in a second range different from the first range, subsequently carrying out a second set of passes, a pass of the second set including second depositing ink on the substrate and emitting radiation from the radiation source toward the second deposited ink, to produce a printed surface having a second surface finish different from the first surface finish, wherein a dose of the emitted radiation of one of the first set of passes and the second set of passes is less than about 20% of the dose of the emitted radiation of the other set of passes.

18. The method according to claim 17 wherein one of the surface finishes is more glossy than the other.

* * * * *